US008658944B2

(12) United States Patent
Clemenz et al.

(10) Patent No.: US 8,658,944 B2
(45) Date of Patent: Feb. 25, 2014

(54) APPARATUS AND METHOD FOR MELTING ICE, SNOW OR THE LIKE IN CONNECTION WITH A FURNACE

(76) Inventors: Daniel Clemenz, Waukegan, IL (US); Gary Apfelbaum, Grayslake, IL (US)

( * ) Notice: Subject to any disclaimer, the term of this patent is extended or adjusted under 35 U.S.C. 154(b) by 800 days.

(21) Appl. No.: 12/860,412

(22) Filed: Aug. 20, 2010

(65) Prior Publication Data

US 2011/0031229 A1 Feb. 10, 2011

Related U.S. Application Data

(63) Continuation-in-part of application No. 11/827,437, filed on Jul. 12, 2007, now abandoned.

(51) Int. Cl.

| | |
|---|---|
| ***H05B 1/00*** | (2006.01) |
| ***H05B 3/06*** | (2006.01) |
| ***F23L 17/14*** | (2006.01) |
| ***F23L 17/16*** | (2006.01) |

(52) U.S. Cl.
USPC ..... 219/213; 219/520; 454/41; 454/43

(58) Field of Classification Search
USPC ..... 219/213, 520, 534, 201, 494, 523, 681, 219/535, 536, 538; 126/112, 77, 110 R, 126/110 C; 392/360, 361, 373, 374, 392/379–385; 454/188, 254, 338, 276, 43, 454/41, 4, 8
See application file for complete search history.

(56) References Cited

U.S. PATENT DOCUMENTS

| | | | | |
|---|---|---|---|---|
| 3,869,529 | A * | 3/1975 | Follette | 261/130 |
| 3,906,925 | A * | 9/1975 | Dyer | 126/110 R |
| 6,584,280 | B1 * | 6/2003 | Wang | 219/494 |
| 6,956,493 | B1 * | 10/2005 | Youngblood | 340/693.9 |
| 2005/0051540 | A1 * | 3/2005 | Ekinge et al. | 219/681 |
| 2007/0207721 | A1 * | 9/2007 | Chang | 454/184 |
| 2007/0264922 | A1 * | 11/2007 | Astourian | 454/43 |
| 2008/0201888 | A1 * | 8/2008 | Nakai | 15/250.001 |

* cited by examiner

*Primary Examiner* — Henry Yuen
*Assistant Examiner* — Hung D Nguyen
(74) *Attorney, Agent, or Firm* — Justin Lampel

(57) ABSTRACT

An apparatus for preventing the accumulation of snow, ice, frost, hail or the like from obstructing the flow of primary air, air or the exhaust into or out of a high-efficiency sealed combustion condensing furnace is provided. The apparatus is also suitable to prevent leaves, animals or other debris from becoming trapped within the air flow pipes of the furnace. The apparatus has a screen which may be electrically connected to a heating device. The apparatus may further be attached to a thermostat to automatically turn the heating device on or off at preset temperatures. The apparatus may be incorporated into new pipes or may be attached onto existing pipes.

11 Claims, 8 Drawing Sheets

APPARATUS AND METHOD FOR MELTING ICE, SNOW OR THE LIKE IN CONNECTION WITH A FURNACE

CROSS REFERENCE TO RELATED APPLICATION

This application is a continuation-in-part application of U.S. Ser. No. 11/827,437, filed Jul. 12, 2007 now abandoned currently pending and claims the benefit with respect to the same. The entire contents of the previous application are incorporated by reference and the Applicants remain the same.

BACKGROUND OF THE INVENTION

The present invention generally relates to an apparatus for preventing the accumulation of snow, ice, frost, hail or the like from obstructing the flow of primary air, air or the exhaust into or out of a furnace. Specifically, a high-efficiency 90% sealed combustion condensing furnace. The apparatus is also suitable to prevent leaves, animals or other debris from becoming trapped within the air flow pipes of the furnace and/or other appliances of the building. The apparatus has a screen which may be electrically connected to a heating device. The apparatus may further be attached to a thermostat to automatically turn the heating device on or off at preset temperatures. The apparatus may be incorporated into new pipes of the furnace or may be attached onto existing pipes of the furnace.

Many homes, commercial buildings and industrial buildings have furnace pipes which have an exposed opening. Typically, these pipes are used to allow the flow of air into or out of the furnace. The problem with many of these pipes is that objects often become trapped within the pipe and prevent the flow of air into or out of the furnace. Some of these objects include, leaves, animals and garbage. Further, a major problem with objects obstructing the flow of air through the pipe is the accumulation of ice, snow, frost, hail or the like within the pipe during cold weather. Some attempts to solve similar problems have been made.

U.S. Pat. No. 7,127,867 to Smeja et al. discloses a method of making a metal snow guard. The snow guard has a solid layer of soldering material on its base to be heated and melted with application of heat to the upper side of the snow guard to solder the base to an underlying metal roof. The soldering material may be applied as spaced spots or projections providing a rough surface on the underside of the snow guard. The amount of solder and/or flux in the solid layer is limited so that the solder and/or flux does not flow outwardly from the snow guard and run down the metal roof thereby damaging or marring the metal roof surface. The snow guards may be formed of a few pieces of sheet metal. The projections of soldering material may be formed by forcing a paste of solder and flux through spaced holes in a plate or screen onto the base.

U.S. Pat. No. 5,901,507 to Smeja et al. discloses a snow guard for restraining ice and snow along the roofs of buildings. The snow guard is of plastic material having a flat base plate with an upstanding snow retention plate upwardly therefrom and laterally across the base. A reinforcing plate extends upwardly from the base plate, as well, serving to reinforce the retention plate. With the reinforcing plate intersecting and abutting the retention plate at a central axis portion of the base plate.

However, these snow guards fail to prevent the accumulation of snow, ice, frost, hail or the like in the mariner described by the present invention. A need, therefore, exists for an improved apparatus which provides an easy and effective manner for preventing snow, ice, frost, hail, or the like from obstructing the flow of air into or out of a high-efficiency 90% sealed combustion condensing furnace or other appliance. Further, a need exists for an improved apparatus which prevents the accumulation of leaves, animals, debris or the like from decreasing the air flow of a pipe into a furnace or other appliance. In addition, a need exists for an improved apparatus which also may prevent carbon monoxide and/or other dangerous gases from accumulating within a furnace or other appliance as a result of restricted airflow out of the furnace.

SUMMARY OF THE INVENTION

The present invention generally relates to an apparatus for preventing the accumulation of snow, ice, frost, hail or the like from obstructing the flow of primary air, air or the exhaust into or out of a high-efficiency 90% sealed combustion condensing furnace or other appliance. The apparatus is also suitable to prevent leaves, animals or other debris from becoming trapped within the air flow pipes of the furnace. The apparatus has a screen which may be electrically connected to a heating device. The apparatus may further be attached to a thermostat to automatically turn the heating device on or off at preset temperatures. The apparatus may be incorporated into new pipes or may be attached onto existing pipes.

High efficiency furnaces are often direct-vent appliances. In these direct vent appliances both the exhaust and intake air (combustion air) are piped directly to or from the outside. No indoor air is utilized. The combustion chambers are sealed for greater control of the combustion process. Often, a second heat exchanger is used in these sealed combustion condensing furnaces. Hot flue gasses may be cooled down to the point where water vapor condenses. At times, the water may drain down a vent and freeze at the end of the pipe. The present device stops helps eliminate the freezing of the water on the pipe and therefore, increases the air flow to and from the furnace.

An advantage of the present invention is to provide an apparatus to prevent the accumulation of snow, ice, frost, hail or the like from obstructing the flow of air into or out of a furnace.

A further advantage of the present invention is to provide an apparatus which prevents leaves, animals or other debris from becoming trapped within an air flow pipe of a furnace.

Another advantage of the present invention is to provide an apparatus which increases the air flow into or out of a furnace which may be easily attached to an existing pipe of the furnace.

And an advantage of the present invention is to provide a device which increases safety of furnaces or other electrical appliances in a home or business.

Yet another advantage of the present invention is to allow the combustion process of an appliance, especially a furnace, to operate in an efficiently and safe manner.

Still another advantage of the present invention is to allow a furnace to operate and perform years after traditional furnaces have failed or have been replaced.

And another advantage of the present invention is to allow a furnace to operate in a clean manner.

Still another advantage of the present invention is to provide a device which uses air pressure to remove snow or ice from a screen of a pipe.

A further advantage of the present invention is to provide an apparatus which increases the air flow into or out of a furnace which may be easily cleaned.

Yet another advantage of the present invention is to provide an apparatus which has holes for allowing melted snow, ice, frost or the like to exit the air flow pipe of a furnace.

In an embodiment, the apparatus for maintaining air flow through a pipe into a furnace has: a generally cylindrical tube having a first end and a second end and a generally hollow interior; a screen located within the generally hollow interior wherein air passing from the first end to the second end passes through the screen and thereafter mixes with a combustible gas and wherein the mixture of the combustible gas and air are heated in a furnace; a heating device located in the generally hollow interior of the cylindrical tube wherein the heating device is electrically connected to the screen wherein the heating device heats the screen and wherein the screen obtains a temperature hot enough to melt ice and snow located on the screen thereby maintaining air flow into the furnace for combustion; an opening along a circumference of the generally cylindrical tube wherein water accumulated within the generally hollow interior may exit the generally cylindrical tube through the plurality of openings; and an electrical cable connecting the heating device to a power source.

In an embodiment, the apparatus has a thermostat electrically connected to the heating device wherein the thermostat regulates the heating device.

And in an embodiment, the apparatus has a plurality of ridges within the generally hollow interior wherein the screen rests within a groove created by the plurality of ridges.

In another embodiment, the apparatus has a plurality of openings along a circumference of the generally cylindrical tube wherein water accumulated within the generally hollow interior may exit the generally cylindrical tube through the plurality of openings.

In another embodiment, the apparatus has a series of louvers near the screen wherein the louvers direct the flow of air within the generally hollow interior.

For a more complete understanding of the above listed features and advantages of the heated screen for melting ice, snow, frost hail or the like, reference should be made to the following detailed description of the preferred embodiments and to the accompanying drawings. Further, additional features and advantages of the present invention are described in, and will be apparent from, the detailed description of the preferred embodiments and from the drawings.

DETAILED DESCRIPTION OF THE PREFERRED EMBODIMENTS

Figure 1:
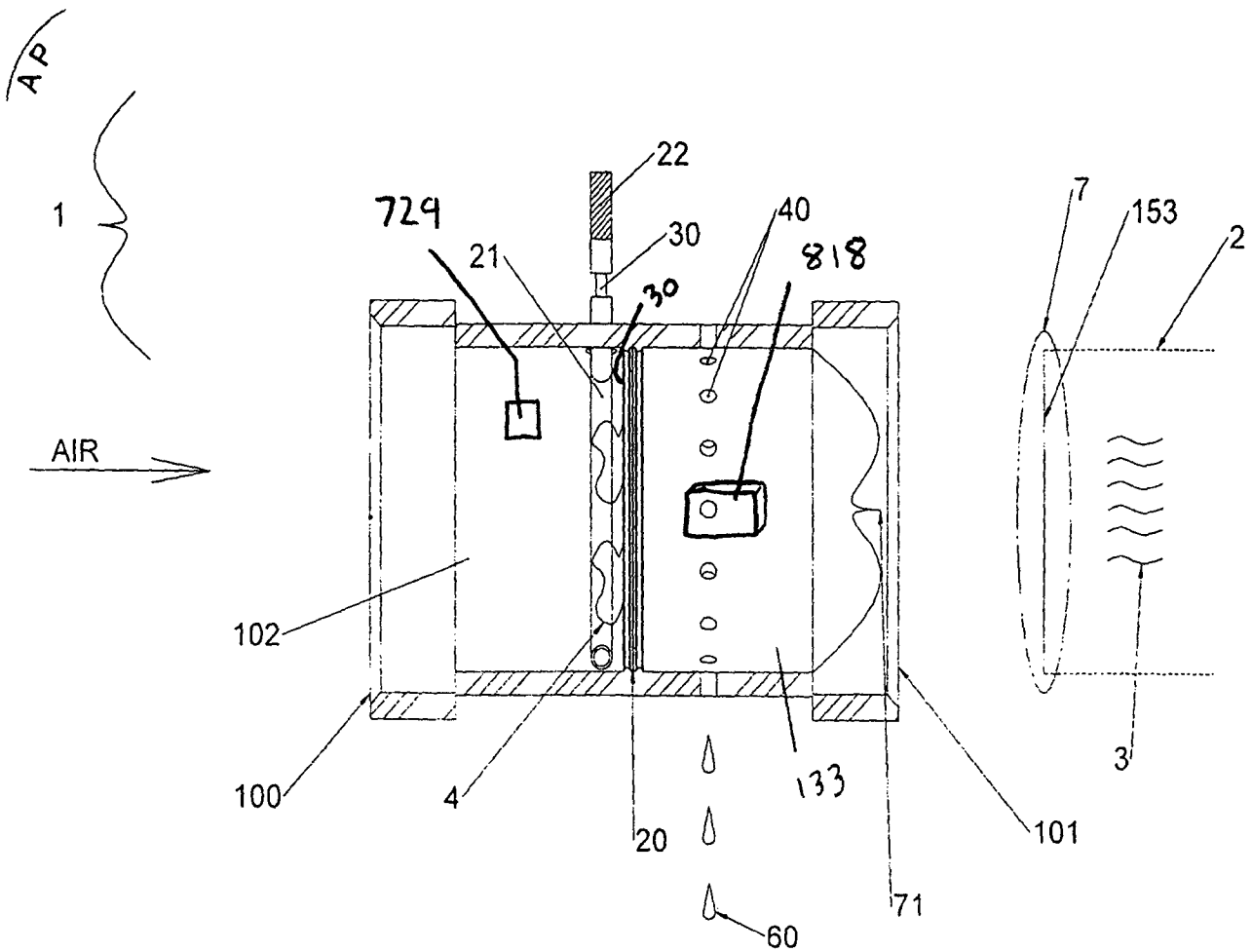
FIG. 1 illustrates a side plan view of the apparatus of the present invention.
Figure 2:
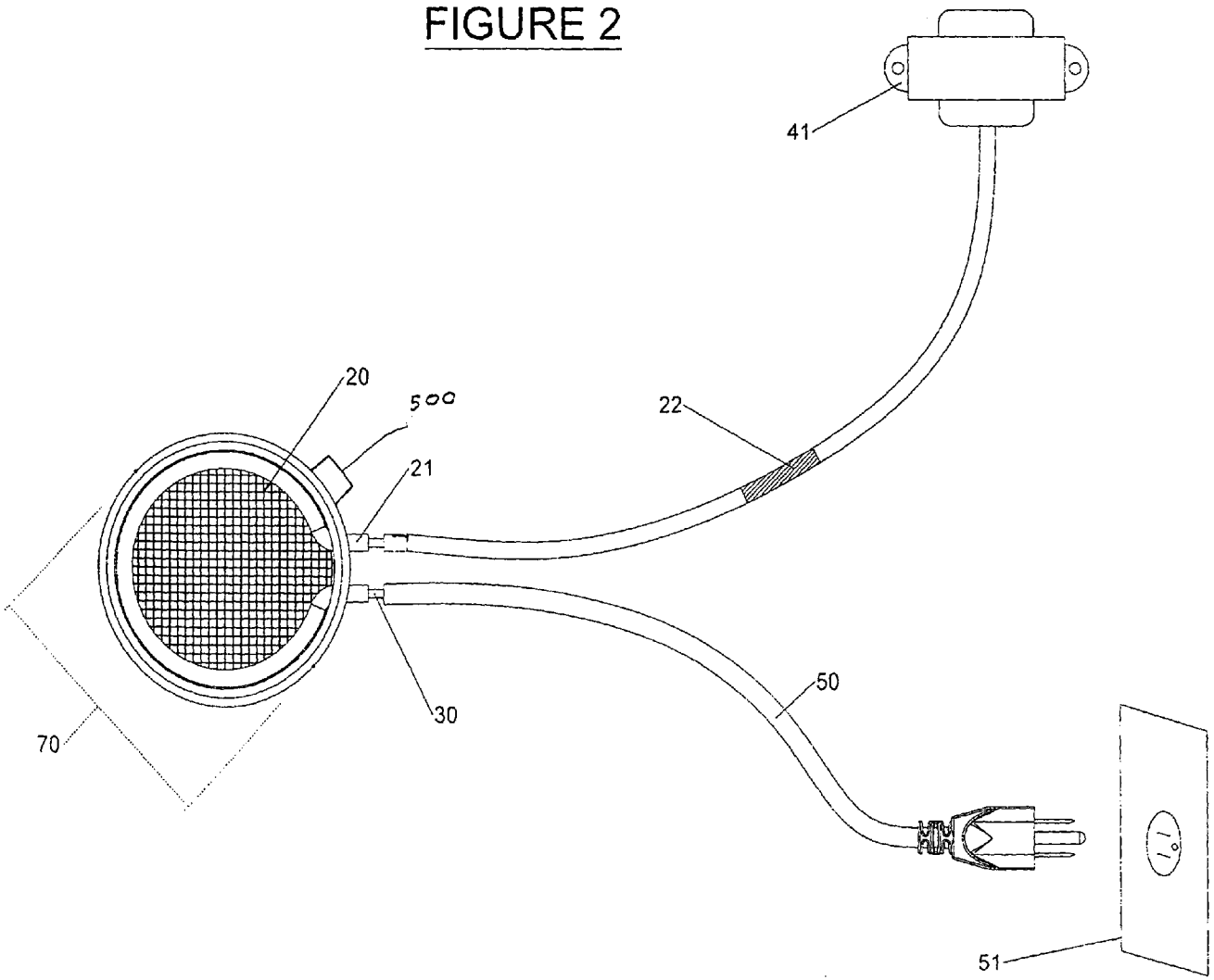
FIG. 2 illustrates a top plan view of the screen of the present invention.

The present invention generally relates to an apparatus for preventing the accumulation of snow, ice, frost, hail or the like from obstructing the flow of primary air, air or the exhaust into or out of a high-efficiency 90% sealed combustion condensing furnace. The apparatus is also suitable to prevent leaves, animals or other debris from becoming trapped within the air flow pipes of the furnace. The apparatus has a screen which may be electrically connected to a heating device. The apparatus may further be attached to a thermostat to automatically turn the heating device on or off at preset temperatures. The apparatus may be incorporated into new pipes or may be attached onto existing pipes.

As stated above, most existing homes have a pipe 2 which connects, for example, a furnace 10 or stove, directly to an exterior 15 of the home. Some of these pipes 2 may be concentric pipes 2 allowing the flow of air in two different directions. It should be noted that the present invention may be used on these concentric pipes as well as single flow pipes 2. The pipes 2 are typically made from PVC, metal or other similar suitable material. The purpose of the pipe 2 is to allow the flow of air 3 directly into or out of the home. It should be noted that the term "furnace" as used in the application generally refers to a high-efficiency 90% sealed combustion condensing furnace.

In the present method, air 3 is not brought directly into the furnace 10 from the outside, but passes through the apparatus 1. Air 3 first passes over the apparatus 1 and is brought into a combustion chamber 47 of the furnace 10 where it is mixed in the combustion chamber with a combustible gas 793 (for example, natural gas, propane or an alternative fuel) and heated and then moved throughout the home. Without the present apparatus 1, the air 3 cannot pass through the pipe 2 and reach the, for example, furnace 10 to interact with the natural gas, propane or other fuel. The present device solves this problem in existing homes or other buildings.

Many of the pipes currently used in homes have screens to prevent debris and/or animals from entering the home. However, there exists no known screen which heats up so as to melt any ice or snow which may build up and block or restrict the flow of air through the pipe of a furnace in the manner described herein. As a result, it is common for the pipes to be largely or completely blocked and, therefore, for the furnace not to work or to work at a lower output. Further, if the pipes become blocked, it is possible for carbon monoxide and/or other dangerous gasses to accumulate, requiring the user to have a service technician clear the pipes.

High efficiency furnaces are often direct-vent appliances. In these direct vent appliances both the exhaust and intake air (combustion air) are piped directly to and from the outside of the building. No indoor air is utilized. The combustion chambers are sealed for greater control of the combustion process. Often, a second heat exchanger is used in these sealed combustion condensing furnaces. Hot flue gasses may be cooled down to the point where water vapor condenses. At times, the water would drain down a vent and freeze at the end of the pipe. The present apparatus 1 helps eliminate the freezing of the water on the pipe and therefore, increases the air 3 flow. If water or snow 4 reduces the air 3 flow, air 3 cannot get to the combustion chamber 47 and the furnace 10 will not operate because the firing in the furnace 10 requires the presence of air 3, in addition to the combustible gas 793, as fuel in the combustion.

FIG. 1 generally illustrates an apparatus 1 of the present invention which is used in conjunction with a pipe 2. The apparatus 1 is particularly suitable to melt ice, snow, sleet, frost 4 or the like; thereby decreasing the constriction of air flow of the pipe 2 through the furnace 10. As a result, air 3 may pass through the pipe 2 more easily. The apparatus 1 may have a first end 100 and a second end 101. The apparatus 1 may be generally in the shape of a cylinder having a hollow interior 102 and an exterior 133. Within the hollow interior 102 of the cylinder may be a screen 20. The screen 20 may be directly molded into the apparatus 1 during the construction of the apparatus 1. Alternatively, the screen 20 may be added to the apparatus 1 (or pipe 2) after the pipe 2 is constructed.

The screen 20 may be generally circular and may have a diameter 70 which is slightly smaller than a diameter 71 of the apparatus 1. More specifically, the screen 20 may extend to cover an entire planar surface within the hollow interior 102 of the apparatus 1 so that any air 3 which passes from the first end 100 of the apparatus 1 to the second end 101 of the apparatus 1 must pass through one of the plurality of openings in the screen 20. In an embodiment, the second end 101 of the apparatus 1 may be secured to an existing end 7 of the pipe 2 of, for example, the home. More specifically, the second end 101 of the apparatus 1 may be secured to the existing pipe 2 by, for example, glue, screws, magnets or the like.

Figure 5:
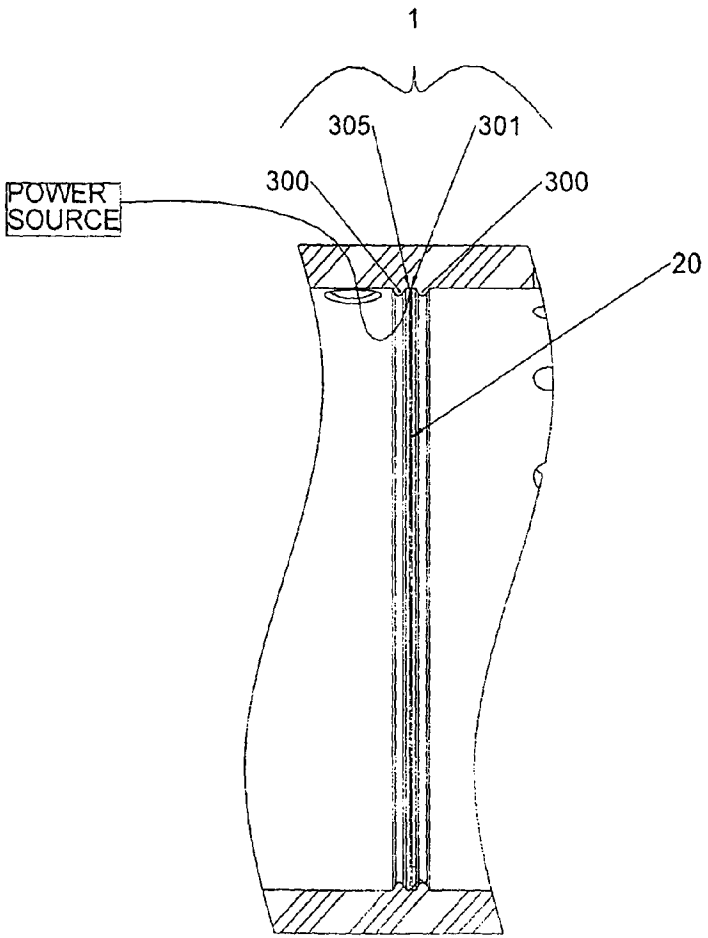
FIG. 5 illustrates a side view of the apparatus wherein the screen is secured within a groove created by two ridges.

Referring now to FIG. 5, within the hollow interior 102 of the apparatus 1 may be two ridges 300. The ridges 300 may be formed as two slightly raised gaskets forming a narrow grove 305 in which the screen 20 may rest in. More specifically, an edge 301 of the screen 20 may rest within the two ridges 300 and secured there by, for example, friction.

The apparatus 1 may be designed to fit on an existing pipe 2. Alternatively, the apparatus 1 may be inserted into the pipe 2 during the production process of the pipe 2. If the apparatus 1 is designed to fit an existing pipe 2 the apparatus 1, the apparatus 1 may, for example, be attached to an end 7 of the pipe 2. In such a case, the apparatus 1 may be inserted within or around the end 7 of a pipe 2. Further, if the apparatus 1 is inserted over the end of an existing pipe 2 of a furnace 10, the apparatus 1 may be easily removed for cleaning and maintenance of the screen 20. If the apparatus 1 is designed to be fitted on an existing pipe 2, the diameter 71 of the second end 101 of the apparatus 1 may be slightly larger than a diameter 153 of the pipe 2. While the apparatus 1 is secured onto the pipe 2, an air and/or water tight sealed may be formed. Further, glue or another substance may be used to create a water-tight seal between the pipe 2 and the apparatus 1.

The apparatus 1 may have, for example, a screen 20, a heating element 21, and a thermostat 22. The heating element 21 may be, for example, embedded into the pipe 2 or may be otherwise attached to the screen 20 so as to allow the individual wires of the screen 20 to heat up. A heat conducting wire 30 may connect the heating element 21 to the screen 20. When the thermostat 22 registers a temperature below a specific preset limit, the heating element 21 may be activated, thereby heating the screen 20. The thermostat 22 may be set to be activated for a predetermined amount of time before being automatically turned off. In an embodiment, the heating element 21 may be manually activated. When the screen 20 is heated by the heating element 21 ice, snow, frost 4 or the like may be melted and the flow of air 3 through the pipe 2 may be restored.

The thermostat 22 works by regulating the temperature of a system so that the system's temperature is maintained near a desired setpoint temperature. There are numerous of different types of thermostats 22, including bi-metal, wax pellet and mechanical, any of which may be used in connection with the present apparatus 1.

In an embodiment, a plurality of holes 40 may be located adjacent to the screen 20 so as to allow water 60, which may be created from the melting snow or ice 4, to exit the pipe 2 without draining into the home. As a result, water 60 created from the melting of the ice 4, snow or the like is less likely to flow into the home and cause any damage to the furnace 10 or other object. Further, the plurality of holes 40 may allow water 60 to exit the apparatus thereby reducing the possibility of corrosion of the screen 20 and or other elements of the apparatus.

In addition to melting ice, snow, frost 4 or the like, the screen 20 may prevent leaves, animals or other obstructions from passing through the pipe 2 and obstructing the air 3 flow through the pipe 2 to the furnace 10. As a result, a person may easily remove the debris from the screen 20 thereby restoring air 3 flow.

Figure 4:
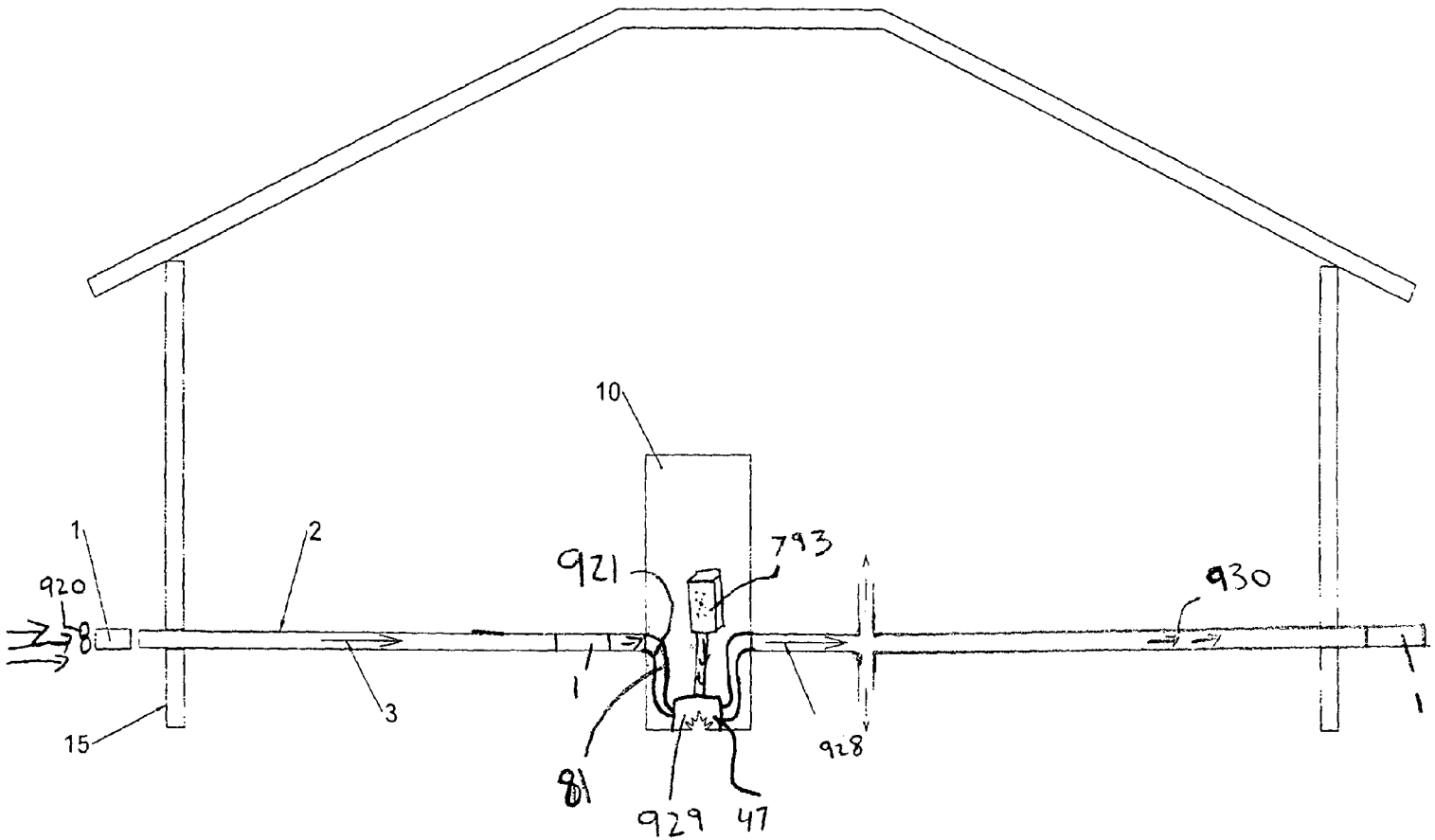
FIG. 4 illustrates an image of the connection points of the present invention to the furnace of a building.

FIG. 4 illustrates two apparatuses 1 present in the pipe prior to entry of the air 3 into the furnace 10. It should be noted that only one apparatus 1 would be present immediately prior to entry of the air 3 into the furnace 10 and the one apparatus 1 would be attached directly to the furnace 10 so as to provide a sealed compartment area 81 for the air 3 directly between the screen 20 and the furnace 10. FIG. 4 shows two alternative apparatuses 1 to illustrate that the apparatus 1 may be located outside the building (or at an exterior all of the building) or may be located attached to or substantially next to the furnace 10 (within the building as described above); the important aspect being the sealed compartment area 81 being present between the screen 20 and the furnace 10. Thus one would not incorporate two apparatus 1 in pipes leading into the furnace 10.

The heating element 21 may be attached to a transformer 41 that is connected to, for example, a home, industrial or commercial voltage supply. The amount of voltage supplied by the transformer 41 may be stepped down from the total voltage of the building so as to increase the safe operation of the apparatus 1. A power chord 50 may attach the heating element 21 to an outlet 51. Preferably, the power chord 50 should be weather proof and resistant to extreme temperatures.

Figure 3:
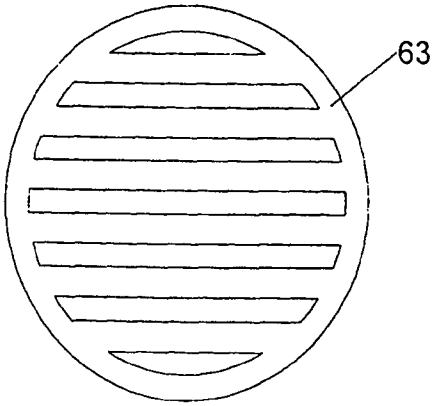
FIG. 3 illustrates a top plan view of the present invention wherein a louver is implemented.

Referring now to FIG. 3, the apparatus 1 may have, for example, a plurality of louvers 63 which may further prevent ice, snow 4 or other obstacles from obstructing the flow of air 3 through the pipe 2. The louvers 63 may be implemented instead of, or in addition to, the screen 20. In such an embodiment, the louvers 63 may be connected to the heating element 21 and may be heated instead of the screen 20 to melt the ice, snow 4 or the like. In an embodiment, the heating element 21 may not only heat the screen 20, but may also heat a portion of the actual pipe 2. As a result, ice, snow 4 or the like may be more easily melted and the flow of air 3 restored more quickly. Further, the louvers 63 may help direct the flow of the melted water from the screen 20.

In an embodiment, the screen 20 of the apparatus is not connected to a heating device, but actually acts as the actual heating device. More specifically, the cross-wires which form the screen 20 are heated up directly from a power source, as opposed to the screen 20 being in contact with a separate heating device. Further, in an embodiment, the metal wires 121 of the device 1 may be interwoven into the screen 20 to allow for maximum exchange of heat to the screen 20.

Figure 6:
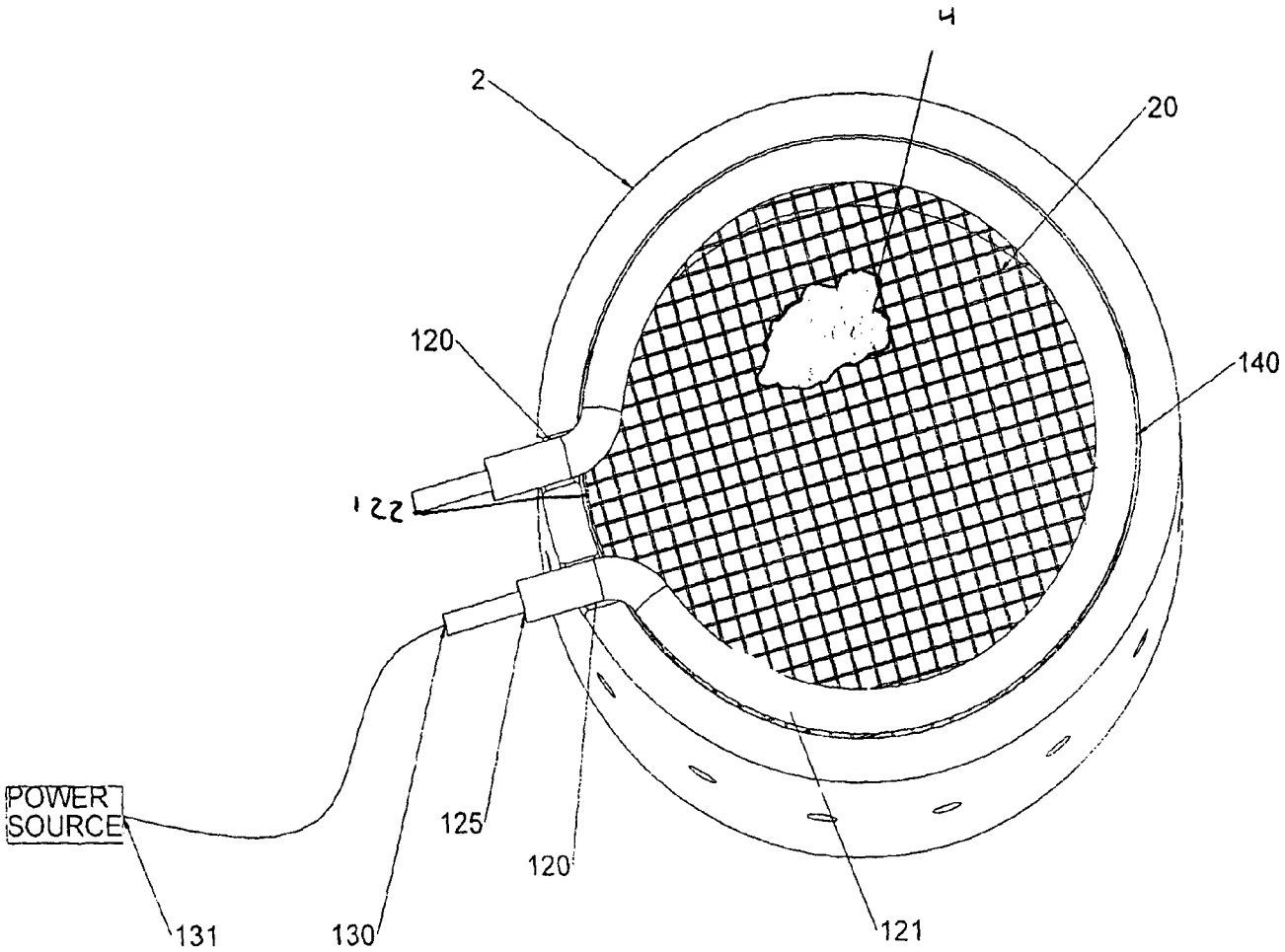
FIG. 6 illustrates a top perspective view of an embodiment of the present invention.
Figure 7:
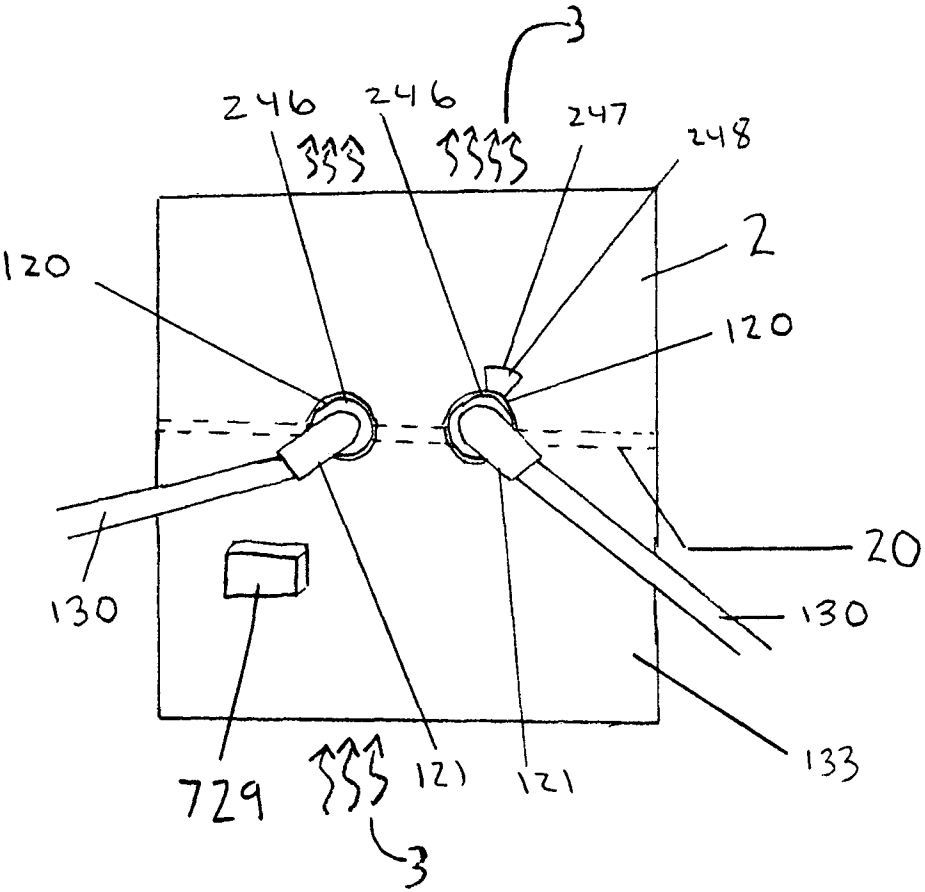
FIG. 7 illustrates a side view of the pipe wherein an O-ring is present.

Referring now to FIG. 6, the apparatus 1 may have a plurality of openings 120 on the side of the pipe 2. The plurality of openings 120 may allow a metal wire 121 to enter, be wrapped around an inner wall 122 of the hollow interior 102 and then exit the hollow interior 102. The metal wire 121 may have a hollow interior 125 in which a wire 130 may be inserted. The wire 130 may be connected to a power source 131 which may heat the wire 130. The heat may then be transferred to the metal wire 121 which is in contact with the screen 20. As a result, the screen 20 of the apparatus may be heated. The metal wire 121 may be secured within the hollow interior 102 of the pipe 2 by, for example, being wedged between the screen 20 and a securing ring 140. In an embodiment, the metal wire 121, wire 130 and screen 20 may all be magnetic such that the metal wire 121 and the wire 130 remain connected to the screen 20 and do not become disconnected during use.

As stated above, the pipe 2 may have a plurality of openings 120 which may allow a metal wire 121 to enter the hollow interior 121 of the pipe 2. In an embodiment, an O-ring 246 may be present between the plurality of openings 120 and the metal wire 121 such that a seal is created between the metal wire 121 and the pipe 2. The O-ring 246 may have an extended tab 247 which may extend outward from the center of the O-ring 246 and onto the exterior 133 surface of the pipe 2. The extended tab 247 may provide a greater surface area to secure the O-ring 246 within the plurality of openings 120 of the pipe 2 and may allow for easy placement and removal of the O-rings 246. Further, an inner surface of the extended tab 247 may have an adhesive 248 which may secure the O-ring 246 extended tab 247 to the pipe 2.

In an embodiment, a vibrating device 729 may be attached to the exterior 133 of the pipe 2. The vibrating device 729 may be powered by a battery or may be plugged into a wall outlet. The vibrating device 729 may be located near the screen 20 located within the interior 102 of the pipe 2. The vibrating device 729 may causes the pipe 2 and/or the screen 20 to vibrate. More specifically, the vibrating device 729 may slightly vibrate the pipe 2 and for screen 20, along with the entire device 1. When the screen 20 vibrates, the ice, snow, sleet and/or frost 4 may fall off the screen 20 thereby maintaining the air flow 3 through the device 1 for use in a combustion chamber 793 of the furnace 10.

In an embodiment, an alternating air pressure device 818 may be associated with, for example, the plurality of holes 40 of the pipe 2. The alternating air pressure device 818 may force pressurized air into the pipe 2 to dislodge ice, snow, sleet and/or frost 4 or other debris from the screen 20; the alternating air pressure device 818 may then suck or pull air away from the screen 20 causing a rocking effect with respect to the air pressure. More specifically, the alternating air pressure device 818 may force air toward the screen 20 for approximately a half second to two seconds and then may reverse and pull air from the alternating air pressure device 818 for approximately a half second to two seconds. The alternating air pressure may force the ice, snow, sleet, frost 4 or other debris from the screen 20. Further, at predetermined times, the alternating between the forced air and sucked air may be stopped and the air 3 may be only vacuumed into the plurality of holes 40 to remove water or other debris from the hollow interior 102 of the pipe 2.

The apparatus 1 may further have an internal limit overload device 500. The internal limit overload device 500 may automatically shut off the apparatus 1 upon reaching a predetermined temperature. More specifically, the internal limit overload device 500 may impose an upper limit on the current that may be delivered to a load with the purpose of protecting the circuit and the apparatus 1.

As stated above, the apparatus 1 may be connected electrically and physically to the furnace 10. More specifically, a tube 2 may directly connect the apparatus 1 to the furnace 10. The area 81 between the screen 20 and the furnace 10 may be sealed such that nothing may enter the area 81 between the screen 20 and the furnace 10 other than the air 3 flowing through the screen 20. As a result, the furnace 10 is more efficient due to the increased air 3 flow.

The first end 100 of the apparatus 1 may be an intake side and the second end 101 of the apparatus 1 may be the outlet side of the apparatus 1. The first end 100 of the apparatus 1 may be open or exposed to a pipe which takes in air 3 and the second end 101 of the apparatus 1 may be directly connected to the furnace 10 (specifically, to the combustion chamber 793 of the furnace 10). Atmospheric air 3 taken in from the first end (inlet side) 100 may pass through the apparatus 1 to the second end (outlet side) 101 of the apparatus 1 and then may pass through the sealed compartment area 81 and into the furnace 10. In the furnace 10, the atmospheric air 3 may mix with a combustible gas 793 (such as natural gas or propane).

Unlike other screens which are used in ventilation systems, an area 81 located between the device 1 and the furnace 10 may be completely sealed and may not be accessible by debris, animals, ice, snow, frost 4 or the like. Further, unlike other devices having screens used in ventilation systems, the present apparatus 1 does not control the pressure of the air 3 in a surrounding building; the present apparatus 1 only controls the movement of air 3 between the screen 20 and the furnace 10.

The apparatus 1 may also be used after the air 3 has passed through the furnace 10. More specifically, the apparatus 1 may be used before and/or after passing through the furnace 10. When used after air 3 passes through the furnace 10, the apparatus 1 may heat up snow, ice, frost 4 or the like which may be formed when the water or water vapor collects at the end of the process just prior to exiting the building. Further, when the apparatus 1 is located and used before and after the air 3 passes through the furnace 10, an entire system may be created wherein air flow 3 of the furnace 10 is protected the entire time the air 3 is associated with the furnace 10.

Figure 8:
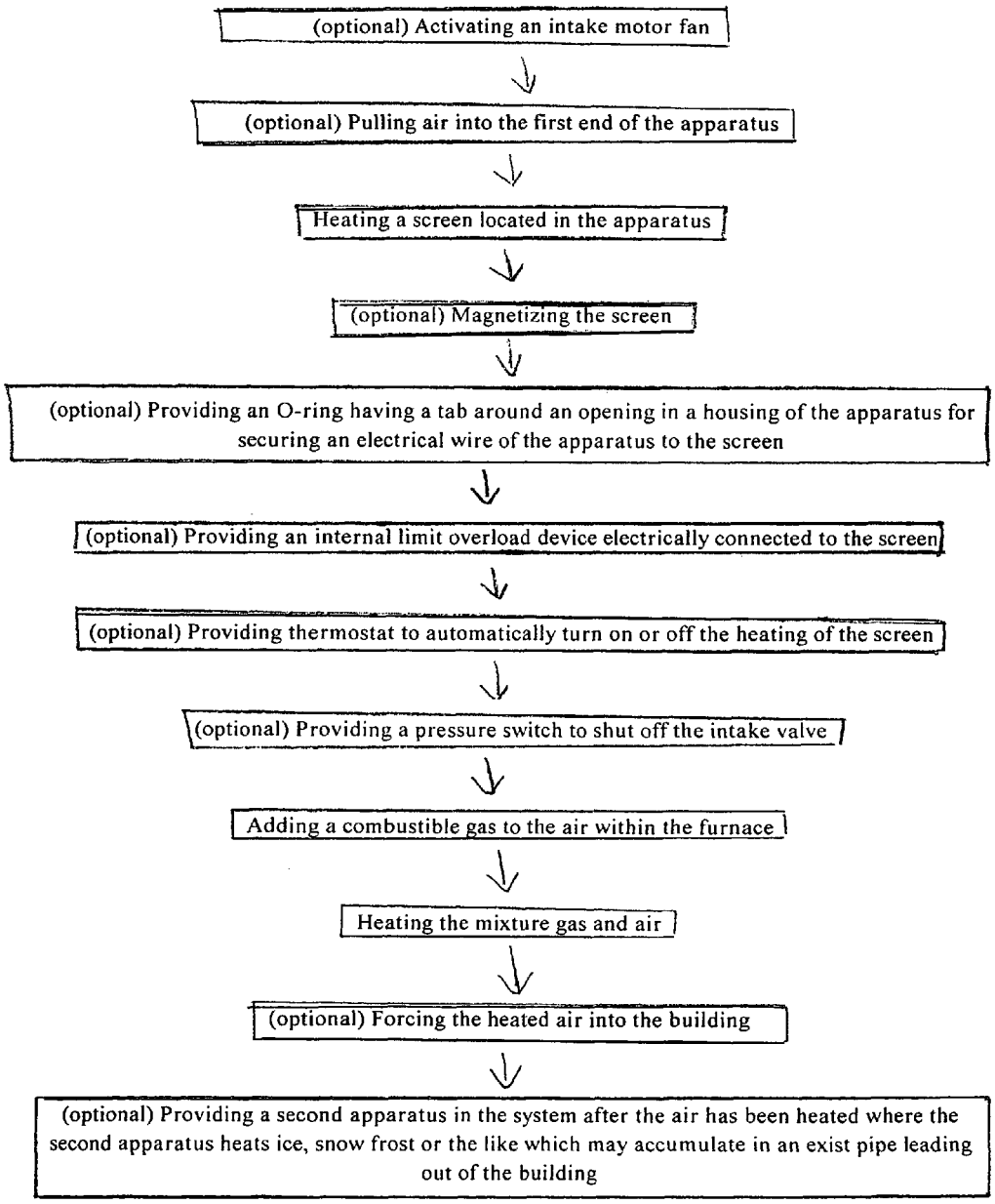
FIG. 8 is a flow chart showing the steps of the apparatus and system.

Referring now to FIG. 8, a flow chart is illustrated showing an embodiment of use of the apparatus 1 and system related to the same. FIG. 4 also illustrates an optional draft intake motor 920 which may be turned on and may pull atmospheric air 3 into the apparatus 1. The air 3 may pass over the screen 20 of the apparatus 1 and may enter the furnace 10. A combustible gas 793 may be added to the air 3 in the furnace 10. A pressure switch 921 may close inside the furnace 10 and the mixture 929 of the air 3 and the combustible gas 793 may be ignited. A second fan may force the warm air 928 out of the furnace 10 into the building. The byproduct air 930 may be forced out of the building after passing over the screen 20 of an optional second apparatus 1 located in the outlet direction of the furnace 10. FIG. 4 illustrates the optional second apparatus 1 located outside the building; although the optional second (outlet) apparatus 1 may also be attached directly to the furnace 10 and inside the building as described above.

Although embodiments of the present invention are shown and described therein, it should be understood that various changes and modifications to the presently preferred embodiments will be apparent to those skilled in the art. Such changes and modifications may be made without departing from the spirit and scope of the present invention and without diminishing its attendant advantages. It is, therefore, intended that such changes and modifications be covered by the appended claims.

We claim:

1. An apparatus for maintaining air flow through a pipe into a high-efficiency sealed combustion condensing furnace comprising:

a generally cylindrical tube having a first end, a second end, a side, an inner side wall and a generally hollow interior;

a circular screen located within the generally hollow interior wherein air passing from the first end to the second end passes through the circular screen and thereafter mixes with a combustible gas and wherein the mixture of the combustible gas and air are heated in a furnace;

a circular heating device located in the generally hollow interior of the cylindrical tube wherein the circular heating device is electrically connected to the circular screen wherein the circular heating device heats the circular screen and wherein the circular screen obtains a temperature hot enough to melt ice and snow located on the circular screen thereby maintaining air flow into the furnace for combustion;

wherein the circular heating device surrounds the circular screen and wherein the circular heating device runs along the inner side wall of the generally cylindrical tube;

a first opening along the side of the generally cylindrical tube wherein water accumulated within the generally hollow interior may exit the generally cylindrical tube through the first opening;

an electrical cable connecting the circular heating device to a power source;

a second opening along the side of the generally cylindrical tube;

wherein the electrical cable is magnetic and wherein the circular screen is magnetic and wherein the electrical cable is magnetically attracted to the circular screen and wherein the electrical cable is secured to the circular screen by magnetic forces; and an o-ring located around the second opening of the side of the generally cylindrical tube wherein the electrical cable passes through the o-ring and wherein the o-ring prevents a liquid from passing through the second opening of the side of the generally cylindrical tube.

2. The apparatus of claim 1 further comprising;

a thermostat electrically connected to the circular heating device wherein the thermostat regulates the circular heating device.

3. The apparatus of claim 1 further comprising:

a plurality of ridges within the generally hollow interior wherein the circular screen rests within a groove created by the plurality of ridges.

4. The apparatus of claim 1 further comprising;

a series of louvers near the circular screen wherein the louvers direct the flow of air within the generally hollow interior.

5. The apparatus for maintaining air flow through a pipe into a high-efficiency sealed combustion condensing furnace of claim 1 further comprising:

a vibrating device located on the side of the generally cylindrical tube wherein the vibrating device vibrates and forces the ice off of the circular screen therein increasing air flow within the generally cylindrical tube.

6. The apparatus for maintaining air flow through a pipe into a high-efficiency sealed combustion condensing furnace of claim 1 further comprising:

a wedged-shaped extension tab secured to the o-ring wherein the wedged-shaped extension tab extends outward from the o-ring but does not surround the o-ring wherein the wedged-shaped extension tab creates additional surface area to secure or remove the o-ring to from the side of the generally cylindrical tube.

7. The apparatus for maintaining air flow through a pipe into a high-efficiency sealed combustion condensing furnace of claim 6 further comprising:

an adhesive located on the wedged-shaped extension tab wherein the adhesive secures the wedged-shaped extension tab to the side of the generally cylindrical tube.

8. The apparatus for maintaining air flow through a pipe into a high-efficiency sealed combustion condensing furnace of claim 1 further comprising:

an air pressure device connected to the generally cylindrical tube wherein the air pressure device forces air at the ice located on the circular screen at a pressure great enough to dislodge the ice from the circular screen therein increasing air flow through the circular screen.

9. The apparatus for maintaining air flow through a pipe into a high-efficiency sealed combustion condensing furnace of claim 8 wherein the air pressure alternates between on and off.

10. The apparatus for maintaining air flow through a pipe into a high-efficiency sealed combustion condensing furnace of claim 1 further comprising:

an internal limit overload device electrically connected to the power source wherein the internal limit overload device automatically shuts off the power source upon reaching a predetermined temperature.

11. An apparatus for maintaining air flow through a pipe of a high-efficiency sealed combustion condensing furnace comprising:

a generally cylindrical tube having a first end and a second end and a generally hollow interior having an inner side wall;

a circular screen located within the generally hollow interior wherein air passing from the first end to the second end passes through the circular screen directly into a sealed compartment and then into a furnace;

a metal wire located within the generally hollow interior wherein the metal wire is in contact with an interior wall of the cylindrical tube;

a circular heating device electrically connected to the metal wire wherein the circular heating device transfers heat to the metal wire and wherein the metal wire obtains a temperature hot enough to melt ice and snow;

an electrical cable connecting the circular heating device to a power source;

an opening along the side of the generally cylindrical tube;

wherein the circular heating device surrounds the circular screen and wherein the circular heating device runs along the inner side wall of the generally cylindrical tube;

wherein the electrical cable is magnetic and wherein the circular screen is magnetic and wherein the electrical cable is magnetically attracted to the circular screen and wherein the electrical cable is secured to the circular screen by magnetic forces; and an o-ring located around the opening of the side of the generally cylindrical tube wherein the electrical cable passes through the o-ring and wherein the o-ring prevents a liquid from passing through the opening of the side of the generally cylindrical tube.

* * * * *